US011279050B2

(12) United States Patent
Onion

(10) Patent No.: US 11,279,050 B2
(45) Date of Patent: Mar. 22, 2022

(54) EASILY DISASSEMBLED FOLDING KNIFE WITH REPLACEABLE BLADE

(71) Applicant: GB II Corporation, Tualatin, OR (US)

(72) Inventor: Kenneth J. Onion, Kaneohe, HI (US)

(73) Assignee: GB II Corporation, Tualatin, OR (US)

( * ) Notice: Subject to any disclaimer, the term of this patent is extended or adjusted under 35 U.S.C. 154(b) by 6 days.

(21) Appl. No.: 16/825,351

(22) Filed: Mar. 20, 2020

(65) Prior Publication Data

US 2020/0307002 A1 Oct. 1, 2020

Related U.S. Application Data

(60) Provisional application No. 62/825,705, filed on Mar. 28, 2019.

(51) Int. Cl.
*B26B 5/00* (2006.01)

(52) U.S. Cl.
CPC ..... *B26B 5/00* (2013.01)

(58) Field of Classification Search
None
See application file for complete search history.

(56) References Cited

U.S. PATENT DOCUMENTS

| | | | |
|---|---|---|---|
| 298,115 | A | 5/1884 | Peace |
| 1,049,931 | A | 1/1913 | Smith |
| 1,182,043 | A | 5/1916 | Schless |
| 1,299,173 | A | 4/1919 | Grey |
| 1,350,251 | A | 8/1920 | Armour |
| 1,353,490 | A | 9/1920 | Pantlalek |
| 1,428,296 | A | 9/1922 | Neft |
| 1,487,655 | A | 3/1924 | Hlavecek |
| 1,667,462 | A | 4/1928 | Logan |

(Continued)

FOREIGN PATENT DOCUMENTS

| | | | |
|---|---|---|---|
| CN | 2194827 | Y | 4/1995 |
| CN | 2275020 | Y | 2/1998 |

(Continued)

OTHER PUBLICATIONS

First Office Action and Search Report (including English translation) from State Intellectual Property Office of the People's Republic of China, for Chinese Patent Application No. 201410076626.0, dated Jun. 10, 2015, 15 pages.

(Continued)

*Primary Examiner* — Hwei-Siu C Payer
(74) *Attorney, Agent, or Firm* — Klarquist Sparkman, LLP

(57) ABSTRACT

A folding knife can include a handle, a pivot mechanism, a blade retention member, and a replaceable blade. The pivot mechanism has a pivot element and an actuation member. The pivot element extends from one side of the handle. The actuation member is coupled to another side of the handle and is selectively movable without use of a tool to lock/unlock the side portions of the handle relative to each other. A proximal portion of the blade is releasably secured to the blade retention member, and a distal portion of the blade extends beyond the blade retention member. The blade retention member is pivotable relative to the handle between an open configuration in which a cutting edge portion of the blade is exposed from the handle and a closed configuration in which the cutting edge portion of the blade is concealed by the handle.

17 Claims, 7 Drawing Sheets

(56) References Cited

U.S. PATENT DOCUMENTS

| | | | | |
|---|---|---|---|---|
| 3,007,244 | A | 11/1961 | Vern | |
| 3,061,927 | A | 11/1962 | Von Frankenburg und Ludwigsdorf | |
| 3,488,843 | A | 1/1970 | Tims, Jr. | |
| 3,829,967 | A | 8/1974 | Gilbert | |
| 4,161,818 | A | 7/1979 | Phelps | |
| 4,218,819 | A | 8/1980 | Phelps | |
| 4,233,737 | A | 11/1980 | Poehlmann | |
| 4,408,394 | A | 10/1983 | Phelps | |
| 4,660,284 | A * | 4/1987 | Decarolis | B23D 51/01 30/157 |
| 4,730,393 | A | 3/1988 | Coburn | |
| 5,022,156 | A | 6/1991 | Kallens et al. | |
| 5,572,793 | A | 11/1996 | Collins et al. | |
| 5,594,966 | A | 1/1997 | Goldman | |
| 5,605,495 | A | 2/1997 | Jenkins, Jr. | |
| 5,661,908 | A * | 9/1997 | Chen | B23D 51/01 30/125 |
| 5,916,277 | A | 6/1999 | Dallas | |
| 6,101,723 | A | 8/2000 | Ford | |
| 6,134,788 | A * | 10/2000 | Chen | B26B 1/046 30/125 |
| 6,446,341 | B1 * | 9/2002 | Wang | B26B 1/046 30/123 |
| 6,591,504 | B2 | 7/2003 | Onion | |
| 6,751,820 | B1 | 6/2004 | Wu | |
| 6,802,126 | B2 | 10/2004 | Huang | |
| 6,865,816 | B1 | 3/2005 | Zajdel | |
| 6,942,255 | B2 | 9/2005 | Pickering | |
| 7,022,915 | B1 | 4/2006 | Galguera | |
| 7,093,367 | B1 * | 8/2006 | Huang | B23D 51/01 30/161 |
| 7,100,285 | B1 | 9/2006 | Huang | |
| 7,134,207 | B2 | 11/2006 | Ping | |
| 7,162,803 | B2 | 1/2007 | Lu | |
| 7,246,441 | B1 | 7/2007 | Collins | |
| 7,370,421 | B2 | 5/2008 | Onion et al. | |
| 7,716,839 | B2 | 5/2010 | Onion et al. | |
| 8,051,518 | B2 | 11/2011 | Massaro | |
| 8,087,173 | B2 | 1/2012 | Tang et al. | |
| 8,499,460 | B1 | 8/2013 | Pearman | |
| 8,893,389 | B2 | 11/2014 | Freeman | |
| 9,061,426 | B2 | 6/2015 | Harvey | |
| 9,259,845 | B2 * | 2/2016 | Gringer | B26B 5/003 |
| 9,492,916 | B2 | 11/2016 | Snyder | |
| 9,586,328 | B2 | 3/2017 | Onion | |
| 9,592,612 | B2 | 3/2017 | Koenig | |
| 9,597,809 | B2 | 3/2017 | Onion | |
| 9,943,970 | B2 | 4/2018 | Glesser | |
| 10,226,871 | B2 | 3/2019 | Huang | |
| 10,538,002 | B2 * | 1/2020 | Korthuis | B26B 5/006 |
| 10,974,398 | B2 * | 4/2021 | Onion | B26B 5/00 |
| 2004/0139613 | A1 | 7/2004 | Onion | |
| 2005/0257377 | A1 | 11/2005 | Lu et al. | |
| 2006/0272157 | A1 | 12/2006 | Zeng | |
| 2007/0011884 | A1 | 1/2007 | Hua et al. | |
| 2008/0172884 | A1 | 7/2008 | Cheng | |
| 2008/0222896 | A1 | 9/2008 | Marfione et al. | |
| 2010/0177508 | A1 | 7/2010 | Maglica | |
| 2010/0281696 | A1 | 11/2010 | Hao et al. | |
| 2011/0041344 | A1 | 2/2011 | De et al. | |
| 2011/0272265 | A1 | 11/2011 | Mortun | |
| 2012/0011728 | A1 | 1/2012 | Keers | |
| 2012/0017443 | A1 | 1/2012 | Hao | |
| 2012/0124754 | A1 | 5/2012 | Frazer | |
| 2012/0272534 | A1 | 11/2012 | Lee | |
| 2013/0174351 | A1 | 7/2013 | Carson | |
| 2014/0027234 | A1 | 1/2014 | Zhou et al. | |
| 2014/0245615 | A1 | 9/2014 | Onion et al. | |
| 2016/0029733 | A1 | 2/2016 | Kovarik et al. | |
| 2016/0031096 | A1 | 2/2016 | Koenig | |
| 2016/0059429 | A1 | 3/2016 | Mayes | |
| 2016/0271809 | A1 | 9/2016 | Bloch | |
| 2016/0311123 | A1 | 10/2016 | Schoon | |
| 2017/0334077 | A1 | 11/2017 | Onion et al. | |
| 2018/0169874 | A1 | 6/2018 | Halucha | |
| 2018/0290282 | A1 | 10/2018 | Wang | |
| 2019/0202073 | A1 | 7/2019 | Huang | |
| 2019/0321991 | A1 | 10/2019 | Medhurst | |
| 2020/0101633 | A1 | 4/2020 | Halucha | |
| 2020/0276722 | A1 * | 9/2020 | Zhou | B26B 5/002 |
| 2020/0307002 | A1 * | 10/2020 | Leong | B26B 5/00 |

FOREIGN PATENT DOCUMENTS

| | | | |
|---|---|---|---|
| CN | 2326401 | Y | 6/1999 |
| CN | 2385854 | Y | 7/2000 |
| CN | 2456890 | Y | 10/2001 |
| CN | 1303762 | A | 4/2004 |
| CN | 2774721 | Y | 4/2006 |
| CN | 2902614 | Y | 5/2007 |
| CN | 201401419 | Y | 2/2010 |
| CN | 201471444 | U | 5/2010 |
| CN | 201500984 | U | 6/2010 |
| CN | 201544254 | U | 8/2010 |
| CN | 104260025 | A | 1/2015 |
| GB | 108823 | A | 8/1917 |
| WO | WO1999/000224 | A2 | 1/1999 |

OTHER PUBLICATIONS

Office Action dated Sep. 24, 2015, issued by the United States Patent and Trademark Office in U.S. Appl. No. 14/197,090, filed Mar. 4, 2014.

Office action dated Jan. 14, 2016, issued by the United States Patent and Trademark Office in related U.S. Appl. No. 14/197,120, filed Mar. 4, 2014.

* cited by examiner

EASILY DISASSEMBLED FOLDING KNIFE WITH REPLACEABLE BLADE

CROSS-REFERENCE TO RELATED APPLICATION

This application claims priority to U.S. Provisional Application No. 62/825,705, filed on Mar. 28, 2019, which is incorporated by reference herein.

FIELD

This disclosure relates generally to tools configured to be easily disassembled. More specifically, this disclosure relates to folding knives.

BACKGROUND

Folding knives are available in various configurations. In some of these configurations, the blade of a folding knife can be removed without the use of tools to facilitate cleaning, sharpening, replacement, or storing of a blade. As examples, U.S. Pat. Nos. 9,586,328, 9,597,809, and 9,862,106 describe knives having removable blades. Such knives can be disassembled without the use of tools, such as a screwdriver or hex key. Because folding knives having removable blades are particularly advantageous in harsh conditions (i.e., in situations where a knife is likely to become dirty or dull, and thus where the ability to clean, sharpen, or replace a blade in the field is important), it is beneficial to provide a folding knife with a removable blade having as simple a structure as possible. Simpler configurations can help to ensure that the blade remains easily removable after use in harsh conditions and that removal of the blade can be accomplished as quickly and reliably as possible. Accordingly, simple mechanisms allowing a folding knife to be easily disassembled are desirable.

Some folding knives have replaceable blades that can be disposed or discarded when they become dull. Disposable blades provide added convenience because a user can simply replace a dull, used blade with a new, sharp blade, rather than having to sharpen the dull blade. Despite their advantages, however, knives with disposable blades have their drawbacks. For example, many disposable blade knives do not reliably secure the blade to the handle. Additionally or alternatively, many disposable blade knifes have complex mechanisms for coupling the blade to and releasing the blade from the knife. These shortcomings can make typical disposable blade knives dangerous and/or difficult to use. Further, many disposable blade knives require proprietary blades, which are often difficult to find and/or expensive to replace. As a result, simple mechanisms allowing for a disposable blade to be secured to a folding knife, allowing quick and easy blade replacement, and/or allowing the use of standard blades are desired.

SUMMARY

This disclosure is directed toward new and non-obvious methods and apparatuses relating to folding knives with replaceable blades. Specifically, disclosed herein are knives providing simple mechanisms that allow a folding knife to be easily disassembled and allow for a disposable blade to be safely secured and replaced. In some embodiments, the mechanisms allow for the use of standard blades.

In one representative embodiment, a folding knife includes a handle, a pivot mechanism, a blade retention member, and a replaceable blade. The handle includes a first side portion and a second side portion, and the first and second side portions of the handle are laterally spaced apart from each other. The pivot mechanism has a pivot element and an actuation member. The pivot element extends laterally from an inner surface of the second side portion of the handle. The actuation member is coupled to the first side portion of the handle and is movable relative to the first side portion of the handle between a first position and a second position without use of a tool. In the first position, the actuation member engages the pivot element and thereby couples the first and second side portions of the handle together. In the second position, the actuation member disengages the pivot element and thereby releases the first and second side portions of the handle from each other. The blade retention member includes a first side portion and a second side portion. The first and second side portions include openings extending laterally therethrough and are configured to receive the pivot element. The replaceable blade has a proximal end portion and a distal end portion. The proximal end portion is disposed between the first and second side portions of the blade retention member and has an opening extending laterally therethrough and configured for receiving the pivot element. The distal end portion extends beyond the blade retention member and comprises a cutting edge portion. The blade retention member and the blade are pivotable relative to the handle about the pivot element between an open configuration in which the cutting edge portion of the blade is exposed from the handle and a closed configuration in which the cutting edge portion of the blade is concealed by the handle.

In some embodiments, when the knife is assembled, the pivot element extends through the openings of the blade retention member and through the opening of the blade, thereby preventing the blade from moving longitudinally relative to the blade retention member and the handle.

In some embodiments, the first and second side portions of the blade retention member comprise mating features that allow the blade to be coupled to and removed from the blade retention member without use of a tool, and the mating features cause the first and second side portions of the blade retention member to interlock such that the blade and the first and second side portions of the blade retention member are prevented from moving vertically relative to each other.

In some embodiments, the mating features comprise a recess formed in the first side portion of the blade retention member and a projection extending from the second side portion of the blade retention member, wherein the recess is configured for receiving the proximal end portion of the blade and the projection of the second side portion of the blade retention member.

In some embodiments, the recess and projection extend laterally.

In some embodiments, the mating features cause the first and second side portions of the blade retention member to interlock such that the blade and the first and second side portions of the blade retention member are prevented from moving laterally relative to each other.

In some embodiments, the mating features form a dovetail type connection.

In some embodiments, the mating features form a tongue-and-groove type connection.

In some embodiments, the blade is a disposable blade.

In another representative embodiment, a folding knife includes a handle, a pivot mechanism, a blade retention member, and a replaceable blade. The handle includes a first side portion and a second side portion, wherein the first and second side portions of the handle are laterally spaced apart and separable from each other. The pivot element is disposed inside the handle. The blade retention member includes a blade-receiving recess and a pivot opening through which the pivot element extends. The replaceable blade is partially disposed in the blade-receiving recess. The blade comprises a pivot opening though which the pivot element extends and a cutting edge portion that extends outside of the blade-receiving recess. The blade retention member and the blade are pivotable relative to the handle between an open configuration in which the cutting edge portion of the blade is exposed from the handle for use and a closed configuration in which the cutting edge portion of the blade is concealed by the handle.

In some embodiments, the blade retention member extends over only one side of the blade.

In some embodiments, the blade retention member comprises first and second side portions positioned on opposite sides of the blade, the first and second side portions comprise mating features that allow the blade to be coupled to and removed from the blade retention member without use of a tool, and the mating features cause the first and second side portions of the blade retention member to interlock such that the blade and the first and second side portions of the blade retention member are prevented from moving vertically relative to each other.

In some embodiments, the mating features comprise the blade-receiving recess formed in the first side portion of the blade retention member and a projection extending from the second side portion of the blade retention member, and the recess is configured for receiving the projection of the second side portion of the blade retention member.

In some embodiments, the recess and projection extend laterally.

In some embodiments, the mating features cause the first and second side portions of the blade retention member to interlock such that the blade and the first and second side portions of the blade retention member are prevented from moving laterally relative to each other.

In some embodiments, the mating features form a dovetail type connection.

In some embodiments, the mating features form a tongue-and-groove type connection.

In some embodiments, the mating features comprise pins and openings, wherein each opening of the mating features is configured for receiving at least a portion of a respective pin.

In some embodiments, the blade is a standard blade.

In some embodiments, the blade is a disposable blade.

In another representative embodiment, a method of disassembling a folding knife is provided. The method includes separating a first side portion of a handle from a second side portion of a handle by moving an actuation mechanism relative to the handle from a first position to a second position without use of a tool, removing a pivot element from a blade retention member without use of a tool, separating a first side portion of a blade retention member from a second side portion of the blade retention member without use of a tool, and removing the blade from the blade retention member without use of a tool.

In some embodiments, prior to separating the first and second side portions of the blade retention member, the method further includes removing the pivot element from the blade.

In another representative embodiment, a blade retention member for a folding knife is provided, and the blade retention member includes a first side portion and a second side portion. The first and second side portions include openings extending laterally therethrough and configured to receive a pivot element of a folding knife. The first and second side portions are configured to receive a blade of the folding knife therebetween.

In some embodiments, the first and second side portions comprise mating features that allow the blade to be coupled to and removed from the blade retention member without use of a tool, and the mating features cause the first and second side portions of the blade retention member to interlock such that the blade and the first and second side portions of the blade retention member are prevented from moving vertically relative to each other.

In some embodiments, the mating features cause the first and second side portions to interlock such that the blade and the first and second side portions are prevented from moving laterally relative to each other.

In some embodiments, the blade is disposed distal relative to the openings of the blade retention member.

In some embodiments, the blade is a standard blade.

In some embodiments, the blade is a disposable blade.

The foregoing and other objects, features, and/or advantages of the disclosed technology will become more apparent from the following description, which proceeds with reference to the accompanying figures, as well as the claims and accompanying drawings.

DETAILED DESCRIPTION

General Considerations

Figure 1:
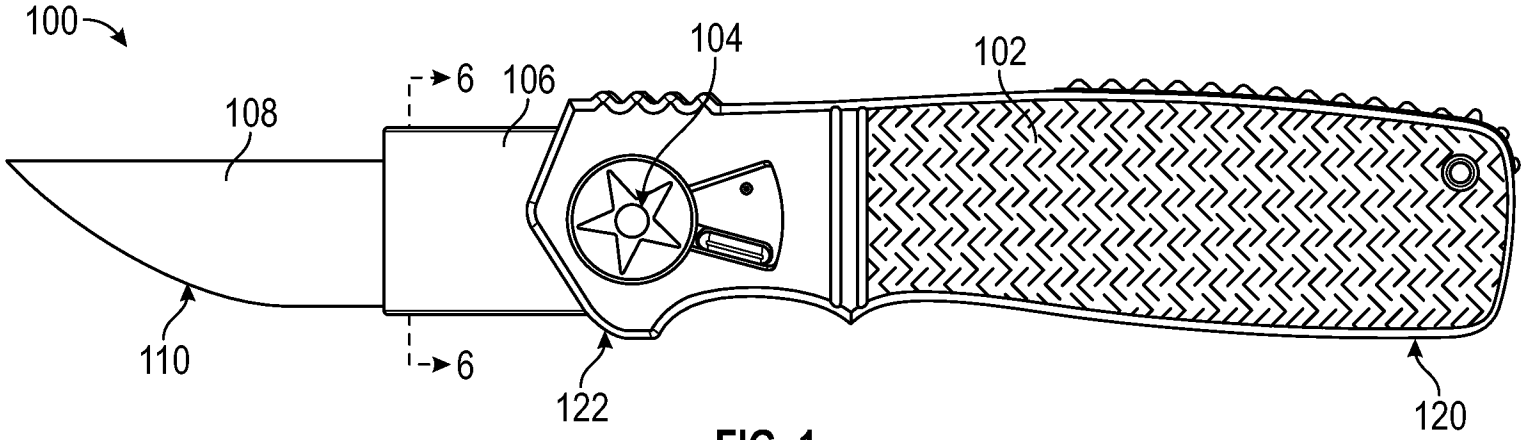
FIG. 1 depicts a side elevation view of an easily disassembled folding knife with a removable blade, showing the knife in an open configuration.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language. For example, operations described sequentially (e.g., assembly or disassembly of a folding knife) may in some cases be rearranged or performed concurrently. Moreover, for the sake of simplicity, the attached figures may not show the various ways in which the disclosed methods can be used in conjunction with other methods. As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C," or "A, B, and C."

As used herein, the term "coupled" generally means physically coupled or linked. Two components that are coupled to the each other can be directly connected to each other or can be indirectly connected to each other with one or more intermediate elements between the coupled items.

EXEMPLARY EMBODIMENTS

The present disclosure concerns folding knives that can be more easily disassembled than some known folding knives, such as for cleaning or replacing a blade or other components. For example, folding knives disclosed herein can be manually disassembled, that is, disassembled without use of a tool (e.g., without a screwdriver, hex key, coin, etc.). In some embodiments, disclosed folding knives include a handle having first and second side portions having complementary locking elements which can prevent the side portions from being separated from one another.

Also disclosed herein are embodiments of folding knives with blade retention members. A blade retention member can be configured to safely support a disposable blade and/or to securely couple the blade to the handle. The disclosed blade retention members can be used with various handle and pivot configurations. The blade retention members disclosed herein can also allow for quick and easy blade replacement. In some embodiments, a blade retention member can allow a standard blade to be used.

Figure 13:
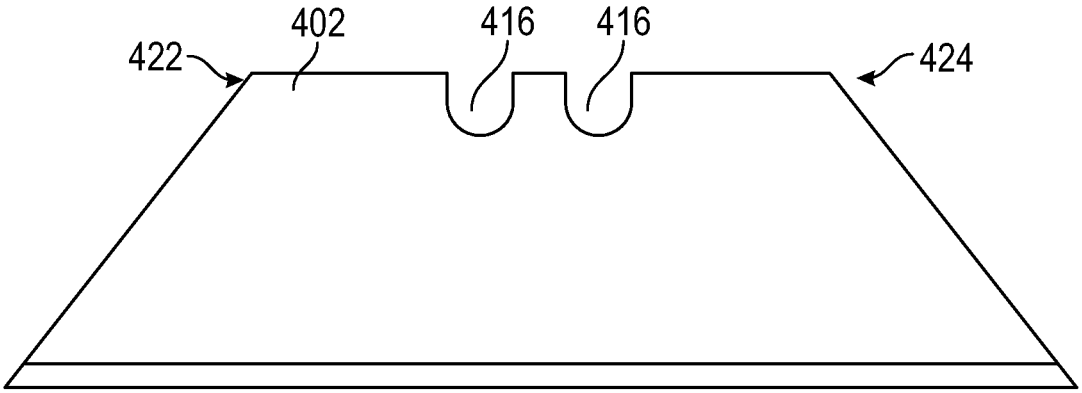
FIG. 13 depicts a side elevation view of the utility blade of FIG. 12.

As used herein, the term "disposable blade" refers to a blade that is intended to be used until dull and then discarded or recycled rather than be sharpened. As used herein, the term "standard blade" refers to a non-proprietary blade type that has generally uniform dimensions (within acceptable tolerances). Standard blades can be used in a variety of knifes and are available from multiple manufactures. FIG. 13 shows one example of a standard utility blade 402.

FIGS. 1-6 show one embodiment of a knife 100 and its components. Referring to FIG. 1, the knife 100 comprises four main components: a handle 102, a pivot mechanism 104, a blade retention member 106, and a blade 108. The blade retention member 106 is pivotably coupled to the handle 102 by the pivot mechanism 104. The blade 108 is fixedly coupled to the blade retention member 106 and pivotably coupled to the pivot mechanism 104. The pivot mechanism 104 allows the blade retention member 106 and the blade 108 to be moved relative to the handle 102 between an open configuration in which a cutting edge 110 of the blade 108 is exposed from the handle 102 (e.g., FIG. 1) and a closed configuration in which the cutting edge 110 of the blade 108 is concealed within the handle 102 (e.g., FIG. 2). The various components, their functionality, and their interaction are further described below.

Figure 2:
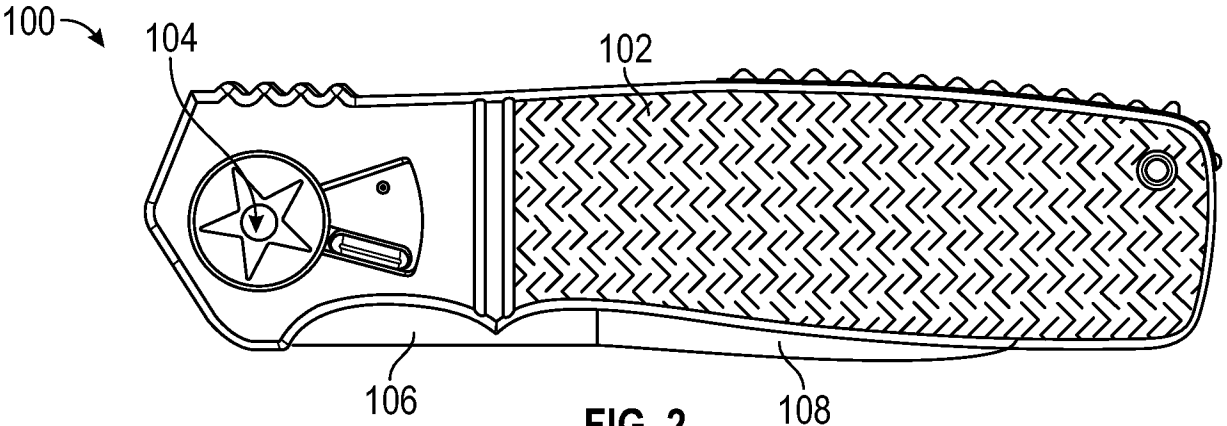
FIG. 2 depicts a side elevation view of the knife of FIG. 1, showing the knife in a closed configuration.
Figure 3:
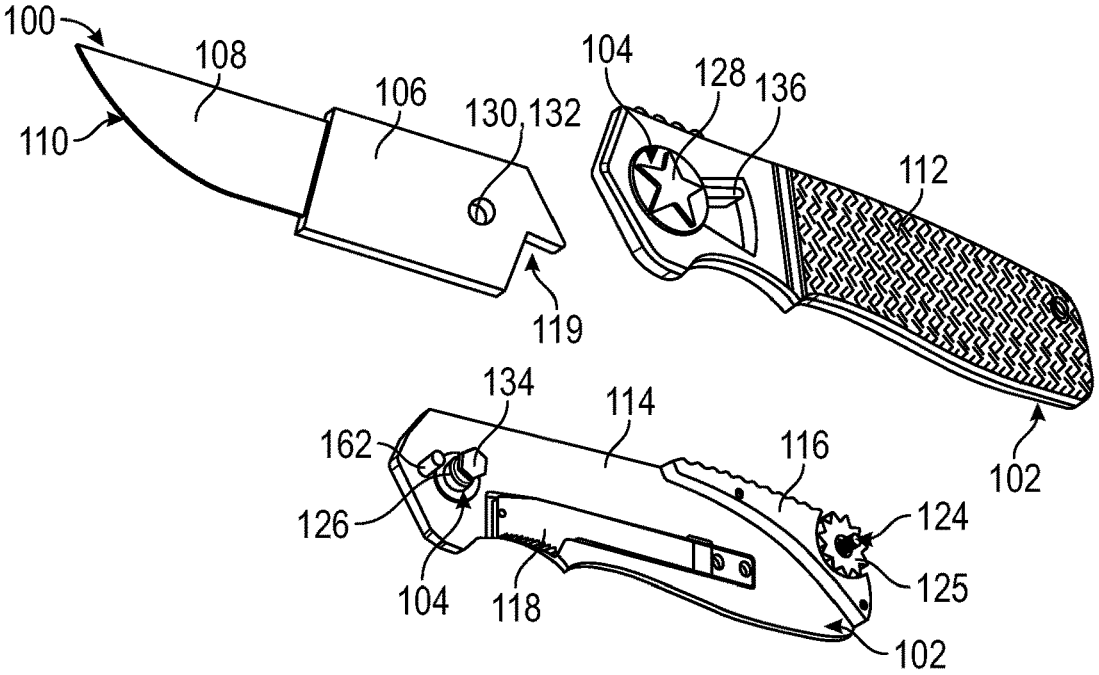
FIG. 3 depicts a partially exploded perspective view of the knife of FIG. 1.

The handle 102 provides a location for the user to grasp the knife 100 when the knife is in the open or closed configurations. The handle 102 also conceals and protects the cutting edge of the blade when the knife is in the closed configuration. Referring to FIG. 3, the handle 102 can include a first side portion 112 and a second side portion 114. When the handle 102 is assembled, the side portions 112, 114 are spaced apart from each other by a distance (e.g., by a spacer member, such as backstrap 116), thereby defining a slot between the two side portions. The slot is configured for receiving the blade retention member 106 and the blade 108 when the knife 100 is in the closed configuration (e.g., FIG. 2).

In some embodiments, the handle 102 can include a locking mechanism configured to selectively retain the blade retention member 106 and the blade 108 in the open configuration during use. For example, as shown in FIG. 3, the second side portion 114 of the handle 102 comprises a frame or liner lock 118 that is biased to a position such that it engages a notched portion 119 of the blade retention member 106 when the knife is in the open configuration. In this manner, the liner lock 118 retains the blade retention member 106 and the blade 108 in the open configuration during use. In some embodiments, the notched portion 119 can be formed on only one side portion of the blade retention member (e.g., either the first or second side portion 138, 140). In other embodiments, the liner lock can be a part of a separate inner liner of the handle that is disposed against the inner surface of the second side portion 114 of the handle 102. In other embodiments, the liner lock can be integrally formed with a side portion of the handle. In yet other embodiments, various other types of locking mechanisms can be used (e.g., a backstrap type lock).

The side portions 112, 114 of the handle 102 can be coupled together by various means. For example, proximal end portions 120 and distal end portions 122 (FIG. 1) of the side portions 112, 114 of the handle 102 can be held together by one or more fasteners on each end portion and/or another coupling means.

In some embodiments, the coupling mechanisms can be a "quick-release" mechanism or another type of mechanism that allows the handles to be coupled/released without the use of tools. As shown in the illustrated embodiment (see FIG. 3), the proximal end portions 120 (FIG. 1) of the handle 102 are coupled together by a screw 124. The screw 124 is coupled to a thumb wheel 125, which a user can rotate with their thumb or finger to couple/release the proximal end portions 120 of the handle 102. The distal end portions 122 (FIG. 1) of the handle 102 are coupled together by the pivot mechanism 104. The pivot mechanism 104 has a lever 136 that can be moved by the user's thumb or finger to couple/release the distal end portions 122 of the handle 102. Additional details about the thumb wheel 125 and the pivot mechanism 104, as well as other means for coupling the side portions of a handle together, can be found below and in U.S. Pat. No. 10,226,871, U.S. Publication No. 2017/0334077 (now U.S. Pat. No. 10,654,180), and U.S. application Ser. No. 16/380,641 (now U.S. Pat. No. 10,882,197), all of which are incorporated by reference herein.

Referring still to FIG. 3, the pivot mechanism 104 comprises a pivot element (e.g., a pivot pin) 126 and an actuation member 128. The pivot element 126 is coupled to and/or extends from an inner surface of the second side portion 114 of the handle 102. When the knife 100 is assembled, the pivot element 126 also extends through an opening 130 of the blade retention member 106, extends through an opening 132 of the blade 108, extends through an opening (not shown) in the first side portion 112 of the handle, and engages the actuation member 128. The actuation member 128 is coupled to the first side portion 112 of the handle 102 and includes a non-circular opening (not shown) configured to selectively engage a non-circular head 134 of the pivot element 126. The actuation member 128 also includes the lever 136, which is configured to move the non-circular opening of the actuation member relative to the first side portion 112 of the handle 102, as the lever 136 is moved relative to the first side portion 112 of the handle 102. The lever 136 is movable relative to the first side portion 112 of the handle 102 between a first position and a second position. When the lever 136 is the first position (FIG. 1), the actuation member 128 engages the pivot element 126 such that the side portions 112, 114 are coupled together, which retains the knife in the assembled configuration (e.g., FIGS. 1-2). When the lever 136 is in the second position (FIG. 3), the actuation member 128 disengages the pivot element 126 such that the side portions 112, 114 are released, which allows the knife to be disassembled (e.g., FIG. 3). Additional details about the illustrated pivot mechanism 104 with the actuation member 128, as well as other pivot mechanisms and actuation members can be found, for example, in U.S. Pat. No. 10,226,871, U.S. Publication No. 2017/0334077 (now U.S. Pat. No. 10,654,180), and U.S. application Ser. No. 16/380,641 (now U.S. Pat. No. 10,882,197).

Figure 4:
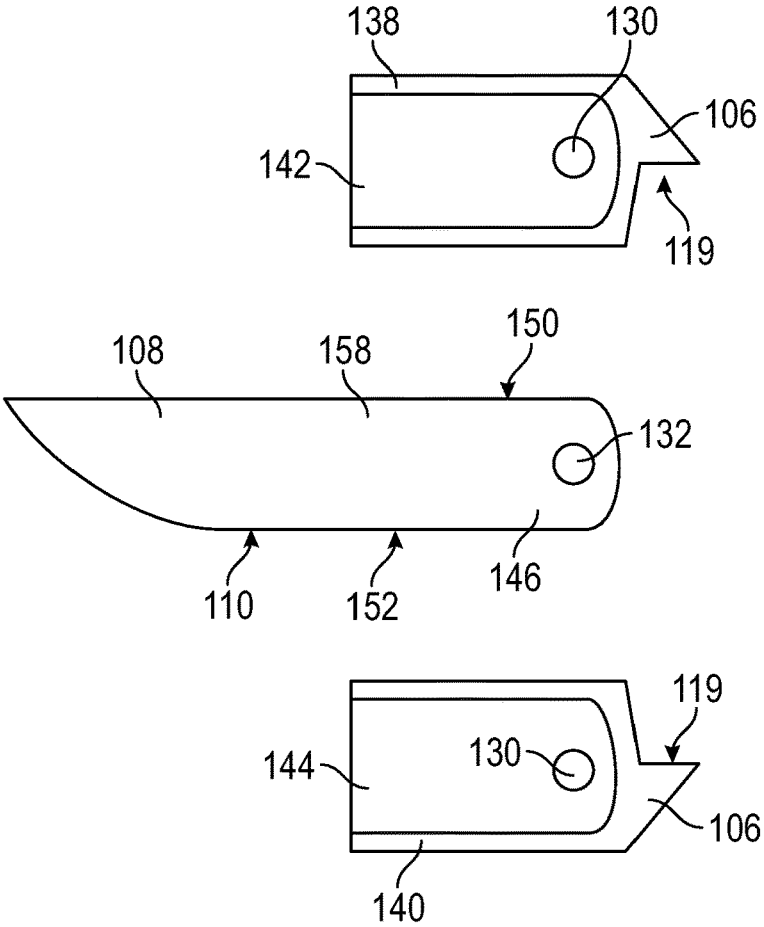
FIG. 4 depicts a side elevation view of a blade retention member (shown disassembled) and a blade of the knife of FIG. 1.

As shown in FIG. 1, the blade retention member 106 of the knife 100 is used to couple the blade 108 to the handle 102. Referring now to FIG. 4, the blade retention member 106 comprises a first side portion 138 and a second side portion 140. As shown in FIGS. 3-4, the side portions 138, 140 of the blade retention member 106 extend over a proximal end portion 146 of the blade 108 and support the blade 108. In other words, the blade 108 can be "sandwiched" between the side portions 138, 140 of the blade retention member 106 such that the blade 108 cannot move relative to the blade retention member 106 when the knife 100 is assembled. In this manner, the blade retention member 106 provides rigidity to the blade 108. The support provided by the blade retention member 106 is advantageous because disposable blades are typically relatively thin and flexible and tend to bend under cutting force if unsupported. This typically makes disposable blades undesirable or dangerous, but the knife 100 overcomes these drawbacks via the blade retention member 106.

The side portions 138, 140 of the blade retention member 106 can comprise mating features such that the side portions 138, 140 and the blade 108 cannot move relative to each other when the knife 100 is assembled and such that the side portions 138, 140 of the blade retention member and the blade 108 can be easily separated from each other without the use of tools. These mating features can be configured to prevent relative movement between the side portions 138, 140 and/or the blade 108 in one or more directions. For example, the mating features can prevent relative movement in a longitudinal (proximal/distal) direction (e.g., left/right in the orientation depicted in FIG. 1), in a vertical direction (e.g., up/down in the orientation depicted in FIG. 1), and/or in a lateral direction (e.g., into/out of the page in the orientation depicted in FIG. 1 or left/right in the orientation depicted in FIG. 6). The mating features of the illustrated embodiment and various other embodiments are described below.

Figure 5:
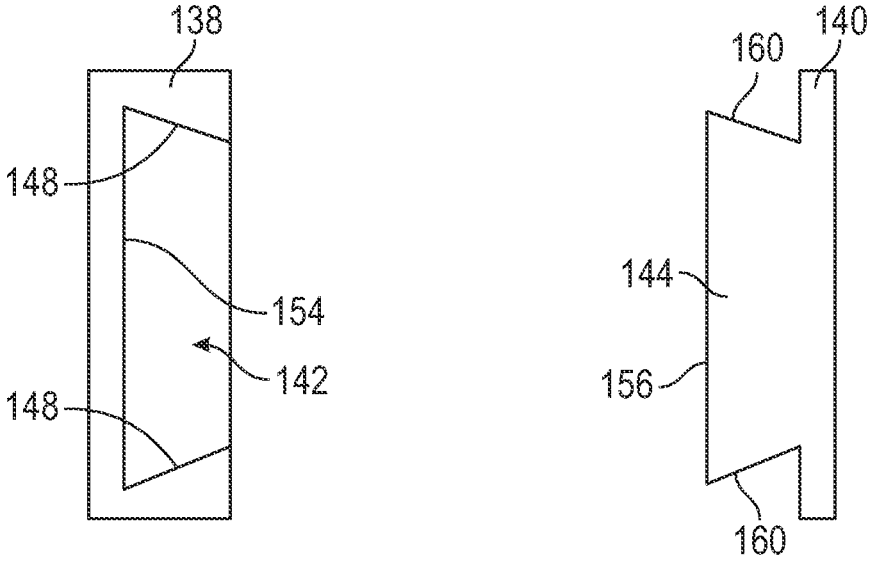
FIG. 5 depicts a front elevation view of a blade retention member (shown disassembled) of the knife of FIG. 1.
Figure 6:
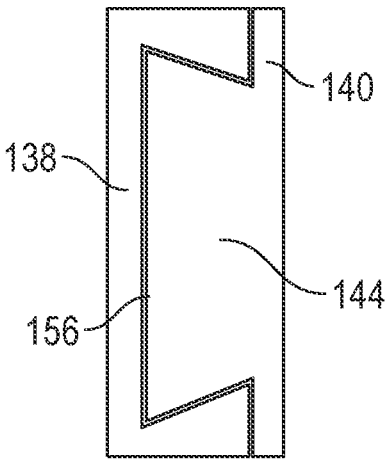
FIG. 6 depicts a partial cross-sectional view of the knife of FIG. 1, taken along the line 6-6 shown in FIG. 1.

Referring to FIG. 5, the blade retention member 106 has mating features comprising a recess and projection that form a "dove-tail" type connection. Specifically, the first side portion 138 of the blade retention member 106 comprises a recess 142, and the second side portion 140 of the blade retention member 106 comprises a projection 144 corresponding to the recess 142 of the first side portion 138. As shown in FIGS. 4-6, the recess 142 of the first side portion 138 is configured for receiving a proximal end portion 146 of the blade 108, and the projection 144 of the second side portion 140 is configured for securing the proximal end portion 146 of the blade 108 within the recess 142. As shown in FIG. 6, first surfaces 148 (FIG. 5) of the first side portion 138 of the blade retention member 106 engage upper and lower surfaces 150, 152 (FIG. 4) of the blade 108 to prevent relative vertical movement (e.g., up/down in the orientation depicted in FIG. 6) between the blade retention member 106 and the blade 108. A second surface 154 of the first side portion 138 of the blade retention member 106 and a third surface 156 of the second side portion 140 of the blade retention member 106 engage side surfaces 158 of the blade 108 relative lateral movement (e.g., left/right in the orientation depicted in FIG. 6) between the blade retention member 106 and the blade 108. To prevent lateral movement between the side portions 138, 140 of the blade retention member 106, the first surfaces 148 of the recess 142 and side surfaces 160 of the projection 144 are angled such that the side portions 138, 140 of the blade retention member interlock in a "dovetail" type connection.

It should be noted that in some embodiments one or more portions of the recess/projection can have a dovetail type connection and one or more other portions of the recess/projection can omit the dovetail type connection.

In other embodiments, the side portions of the blade retention member can include additional or alternative mating features. Additional examples are described below (see, e.g., FIGS. 7-8).

The blade retention member 106 and blade 108 of the knife 100 can be assembled (e.g., FIG. 3) by sliding the proximal end portion 146 of the blade 108 longitudinally into the recess 142 of the first side portion 138 of the blade retention member 106 such that the opening 132 of the blade 108 aligns with the opening 130 of the first side portion 138. The second side portion 140 of the blade retention member 106 can be coupled to the first side portion 138 of the blade retention member 106 by sliding the projection 144 of the second side portion 140 longitudinally into the recess 142 of the first side portion 138 and over the proximal end portion 146 of the blade 108 and by aligning the openings 130 of the blade retention member 106 with the opening 132 of the blade 108, as shown in FIG. 3. As mentioned above, in this configuration, the blade 108 cannot move vertically or laterally relative to the blade retention member 106.

Referring now to FIG. 3, the blade retention member 106 and the blade 108 can be coupled to the handle 102. This can be accomplished by inserting the pivot element 126, which extends from the second side portion 114 of the handle 102, through the openings 130 of the blade retention member 106 and through the opening 132 of the blade 108. With the pivot element 126 positioned through the openings 130, 132, the blade 108 cannot move longitudinally (or vertically or laterally) relative to the blade retention member 106. Thus, the blade 108 is secured in all directions relative to the blade retention member 106. The first side portion 112 of the handle 102 can then be secured to the second side portion 114 of the handle 102 using the actuation member 128, as described above. Once coupled to the handle 102, the blade 108 together with the blade retention member 106 can pivot relative to the pivot element 126 and the handle 102 between the open configuration (FIG. 1) and the closed configuration (FIG. 2).

When a user desires to exchange the blade 108, the user can easily disassemble the knife 100 by simply reversing the steps described above. Thus, the knife 100 comprises simple mechanisms that allow the knife 100 to be easily assembled/disassembled and allow for a disposable blade to be safely secured and replaced.

Figure 12:
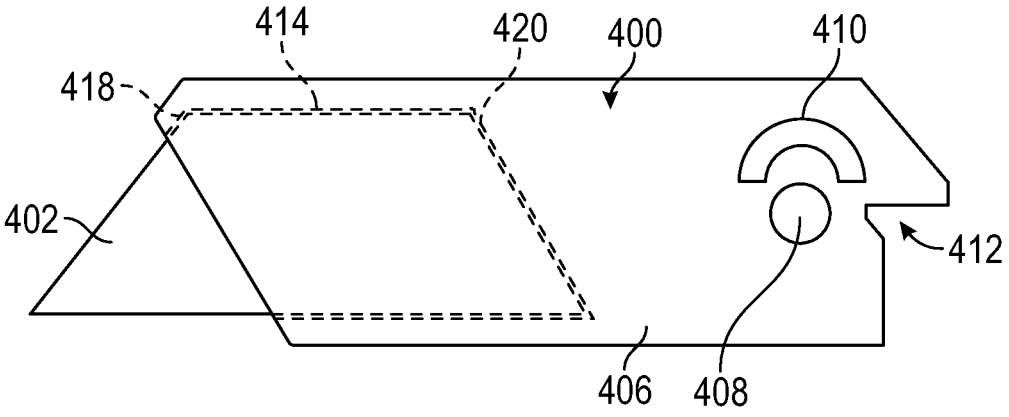
FIG. 12 depicts a side elevation view of another embodiment a blade retention member and a utility blade.

Although not shown, in some embodiments, the blade retention member 106 can include a guide pin opening (see, e.g., the guide pin opening 410 of the blade retention member 400 shown in FIG. 12) configured for receiving a guide pin 162, which is coupled to and/or extends from the second side portion 114 of the handle 102, as shown in FIG. 3.

Figure 7:
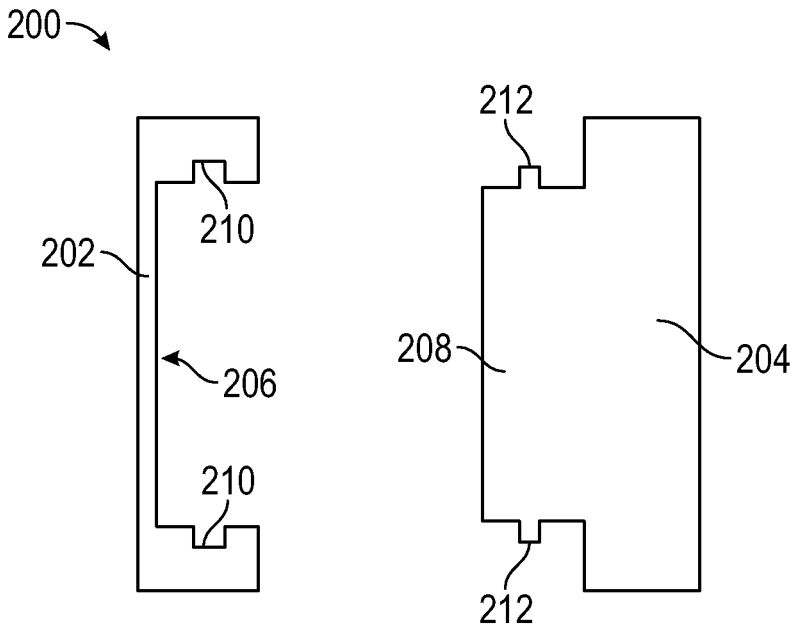
FIG. 7 depicts a front elevation view of another embodiment of a blade retention member (shown disassembled).
Figure 8:
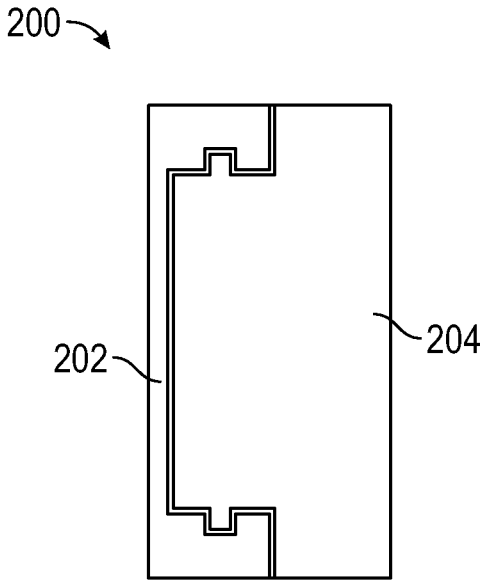
FIG. 8 depicts a front elevation view of the blade retention member of FIG. 7 (shown assembled).

FIGS. 7-8 show another exemplary blade retention member 200. The blade retention member 200 can be used, for example, with the knife 100 in lieu of the blade retention member 106. The blade retention member 200 comprises a first side portion 202 and a second side portion 204. The first side portion 202 has a recess 206 configured for receiving a portion of a blade (not shown) and a projection 208 of the second side portion 204. Additionally, the first side portion has grooves 210 configured for receiving ribs 212 of the second side portion. In this manner, the grooves 210 and ribs 212 together form a "tongue-and-groove" type connection between the side portions 202, 204, which interlocks the side portions and can prevent lateral movement therebetween.

Figure 9:
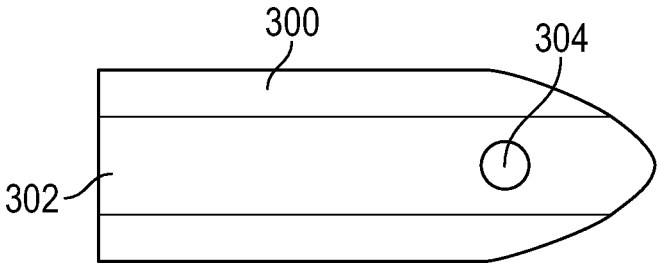
FIG. 9 depicts a side elevation view of another embodiment of a blade retention member.
Figure 10:
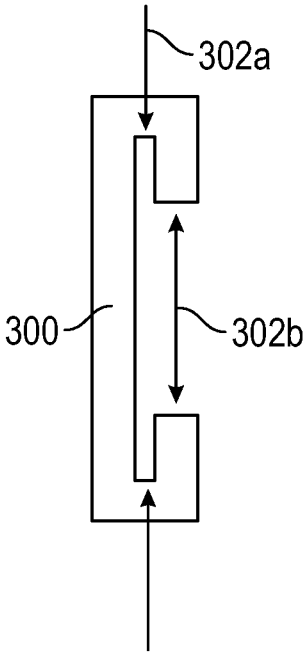
FIG. 10 depicts a front elevation view of the blade retention member of FIG. 9.
Figure 11:
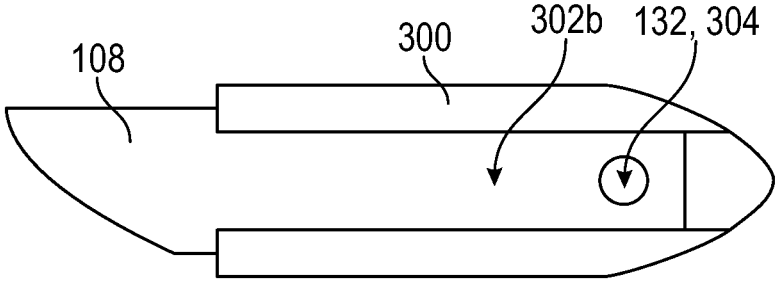
FIG. 11 depicts a side elevation view of the blade retention member of FIG. 9 together with the blade of the knife of FIG. 1.

FIGS. 9-11 show another exemplary blade retention member 300. The blade retention member 300 can be used, for example, with the knife 100 in lieu of the blade retention member 106. Referring to FIGS. 9-10, the blade retention member comprises a recess 302 and an opening 304. In this manner, the blade retention member 300 is similar to the first side portion 138 of the blade retention member 106.

As shown in FIG. 10, the recess 302 of the blade retention member 300 can have a wide portion 302*a*, and a narrow portion 302*b*. The wide portion 302*a* of the recess 302 can be configured for receiving a blade (e.g., the blade 108), as shown in FIG. 11. The narrow portion 302*b* of the recess 302 can be configured to allow a user to access a side surface of the blade (e.g., for slide the blade into/out of the recess 302) while also protecting the user's finger from the cutting edge of the blade.

When the blade 108 is inserted into the blade retention member 300 (as shown in FIG. 11) and the blade retention member 300 is coupled to the knife handle 102 (FIG. 3), the pivot element 126 (FIG. 3) of the knife 100 extends through the opening 304 of the blade retention member 300 and the opening 132 of the blade 108. As such, the pivot pin 126 prevent relative longitudinal movement between the blade retention member 300, the blade 108, and the handle 102. The surfaces of the blade retention member 300 that define the wide portion 302*a* of the recess 302 contact the blade 108 and prevent relative vertical and longitudinal movement between the blade 108 and the blade retention member 300.

In some embodiments, the recess of the blade retention member can have a uniform width (rather than a wide portion and narrow portion). In such embodiments, the blade retention member contacts the upper and lower surfaces of the blade, as well as one side surface of the blade. As such, the blade retention member prevents relative vertical movement (e.g., pivoting about the pivot element) between the blade and the blade retention member. To prevent relative lateral movement between the blade, the blade retention member, and the handle, one side portion of the handle contacts the other side of the blade.

In some embodiments, the blade retention member 300 can be formed with a closed slot rather than an open recess. The slot can be configured for receiving the blade (e.g., similar to the wide portion 302*a* of the recess 302) but would not be open on the side.

In other embodiments, a blade retention member can include a first side portion with laterally-extending pins or shafts (e.g., disposed outside of the blade-receiving recess) and a second side portion with openings corresponding to the pins of the first side portion. The pins and openings can be configured to form a "snap-fit" type connection between the side portions which can prevent the side portions from separating while the knife is in use but also allows the side portions to be separated (e.g., with a user's fingers) in order to change the blade.

FIG. 12 shows another embodiment of a blade retention member 400. Generally speaking, the blade retention member 400 can be configured similar to the blade retention member 106 in that it is configured to secure a replaceable blade relative to a handle of a folding knife. In some embodiments, the blade retention member 400 can be configured for use with a standard utility blade, such as utility blade 402 shown in FIGS. 12-13. The blade retention member 400 can also be configured for use with various other types of standard and non-standard blades.

Referring again to FIG. 12, the blade retention member 400 can comprise a first side portion 406 and a second side portion (not shown). The blade retention member 400 can also comprise a pivot opening 408 and a guide pin opening 410 extending through the first and second side portions. In some embodiments, a proximal end of the blade retention member 400 can comprise a locking feature 412 configured to receive a corresponding locking member coupled to or integrally formed with a knife handle.

The first side portion 406 of the blade retention member 400 comprises a recess 414 on an inwardly-facing surface. The recess 414 is configured to receive a portion of the utility blade 402 and to leave a portion of the utility blade 402 exposed from the blade retention member 400. The recess 414 has a partial trapezoid to correspond to the trapezoidal shape of the utility blade. The surfaces of the first side portion 406 that define the recess 414 prevent the utility blade 402 from moving vertically (e.g., up/down in the orientation depicted in FIG. 12) relative to the first side portion.

Although not shown, blade retention member 400 can include protrusions or pins that extend laterally within the recess 414 of the first side portion 406. The protrusions can be configured to mate with the notches 416 (FIG. 13) of the utility blade 402 to prevent the utility blade 402 from moving longitudinally (e.g., left/right in the orientation depicted in FIG. 12) relative to the first side portion.

In lieu of or in addition to protrusions of the blade retention member 400 mating with the notches 416 of the utility blade 402, the surfaces of the first side portion 406 that define the recess 414 can (at least partially) engage edges of the utility blade 402 to prevent the utility blade 402 from moving longitudinally. For example, as shown in FIGS. 12-13, first and second surfaces 418, 420 of the blade retention member 400 that define the recess 414 can engage adjacent surfaces 422, 424 of the utility blade 402 to prevent the utility blade 402 from moving longitudinally. This configuration can be particularly useful in combination with a pin/opening connection between the first and second side portions of the blade retention member 400, which is further described below.

To prevent lateral movement of the utility blade 402, the second side portion of the blade retention member 400 can comprise a projection configured to extend laterally into the recess 414 of the first side portion 406 such that the utility blade 402 is pinched or sandwiched between the side portions of the blade retention member.

In order to prevent lateral separation between the side portions of the blade retention member 400, the side portions can include mating features. For example, in some embodiments, the blade retention member can include a "dovetail" type connection similar to that of the blade retention member 106 described above and shown in FIGS. 1-6. In other embodiments, the blade retention member can include a "tongue-and-groove" type connection similar to that of the blade retention member 200 described above and shown in FIGS. 7-8. In yet other embodiments, the protrusions or pins of the first side portion can be configured to releasably interlock with openings in the second side portion in a "snap-fit" type connection.

Figure 14:
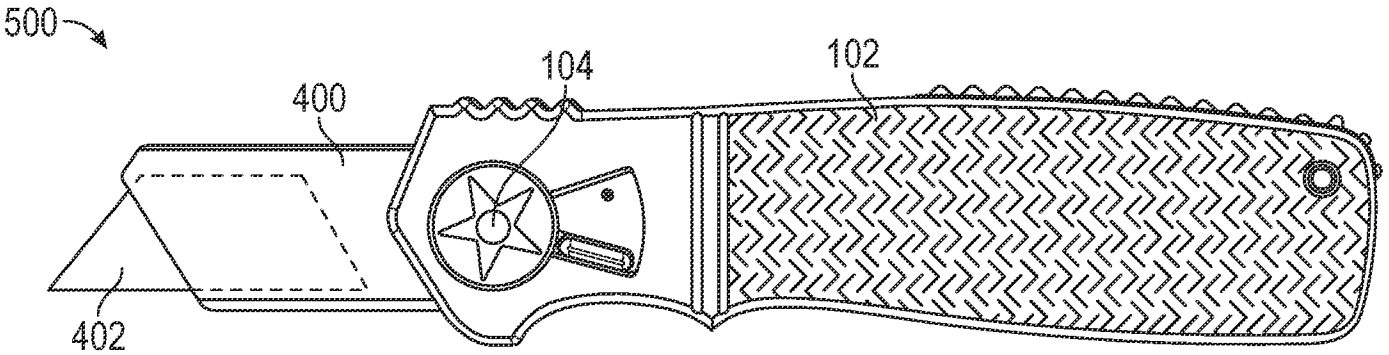
FIG. 14 depicts a side elevation view of another embodiment of an easily disassembled folding knife, showing the knife in an open configuration.
Figure 15:
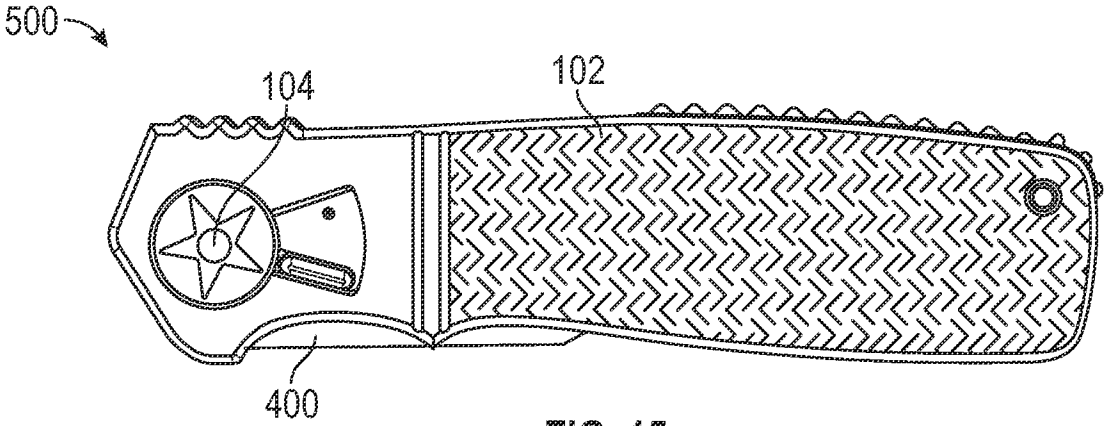
FIG. 15 depicts a side elevation view of the knife of FIG. 14, showing the knife in a closed configuration.

FIGS. 14-15 show a knife 500. The knife 500 comprises the handle 102, the pivot mechanism 104, the blade retention member 400, and the utility blade 402. As shown, the blade retention member 400 and utility blade 402 can pivot about the pivot mechanism between an open configuration (FIG. 14) and a closed configuration (FIG. 15).

Any of the blade retention members disclosed herein (e.g., the blade retention members 106, 200, 300, 400) can be adapted for use with the easily disassembled handle and pivot mechanisms described in U.S. Pat. No. 10,226,871, U.S. Publication No. 2017/0334077 (now U.S. Pat. No. 10,654,180), and U.S. application Ser. No. 16/380,641 (now U.S. Pat. No. 10,882,197).

In any embodiment described herein, the handle can be configured with a storage compartment for storing one or more replacement blades and/or a knife can be provided with a clip secured to the handle so that the knife can be clipped onto, for example, a user's belt or pocket.

The embodiments disclosed herein provide advantages over prior folding knives, including prior folding knives having removable blades. For example, some of the knives disclosed herein have a simple construction which can increase reliability of the knife and simplify the process of removing or replacing the blade. The handle and the blade retention member can be disassembled and the blade can be removed or replaced by hand without using any tools and without removing any small parts, thereby reducing or eliminating the chance of losing a part of the knife. Also disclosed embodiments provide simple blade retention members that allow for a disposable blade to be easily replaced and to be safely secured relative to a handle. Also, the disclosed embodiments can in some instances allow for the use of replacement standard blades.

The structural features described herein, with regard to any example, can be used separately and/or combined with other structural features described in any one or more of the other examples. For example, one or more features of the blade retention member 106 can be combined with any one or more features of the blades retentions members 200, 300, and/or 400 or vice versa.

In view of the many possible embodiments to which the principles of the disclosure may be applied, it should be recognized that the illustrated embodiments are only examples and should not be taken as limiting the scope of the claims. Rather, the scope of the claimed subject matter is defined by the following claims and their equivalents.

The invention claimed is:

1. A folding knife comprising:

a handle comprising a first side portion and a second side portion, wherein the first and second side portions of the handle are laterally spaced apart from each other;

a pivot mechanism having a pivot element and an actuation member, wherein the pivot element extends laterally from an inner surface of the second side portion of the handle, wherein the actuation member is coupled to the first side portion of the handle and is movable relative to the first side portion of the handle between a first position and a second position without use of a tool, wherein in the first position the actuation member engages the pivot element and thereby couples the first and second side portions of the handle together, and wherein in the second position the actuation member disengages the pivot element and thereby releases the first and second side portions of the handle from each other;

a blade retention member comprising a first side portion and a second side portion, wherein the first and second side portions of the blade retention member comprise openings extending laterally therethrough and configured to receive the pivot element; and a replaceable blade having a proximal end portion and a distal end portion, wherein the proximal end portion is disposed between the first and second side portions of the blade retention member and has an opening extending laterally therethrough and configured for receiving the pivot element, wherein the distal end portion extends beyond the blade retention member and comprises a cutting edge portion, wherein the blade retention member and the blade are pivotable relative to the handle about the pivot element between an open configuration in which the cutting edge portion of the blade is exposed from the handle and a closed configuration in which the cutting edge portion of the blade is concealed by the handle.

2. The folding knife of claim 1, wherein when the knife is assembled, the pivot element extends through the openings of the blade retention member and through the opening of the blade, thereby preventing the blade from moving longitudinally relative to the blade retention member and the handle.

3. The folding knife of claim 1, wherein the first and second side portions of the blade retention member comprise mating features that allow the blade to be coupled to and removed from the blade retention member without use of a tool, and wherein the mating features cause the first and second side portions of the blade retention member to interlock such that the blade and the first and second side portions of the blade retention member are prevented from moving vertically relative to each other.

4. The folding knife of claim 3, wherein the mating features comprise a recess formed in the first side portion of the blade retention member and a projection extending from the second side portion of the blade retention member, and wherein the recess is configured for receiving the proximal end portion of the blade and the projection of the second side portion of the blade retention member.

5. The folding knife of claim 4, wherein the recess and the projection extend laterally.

6. The folding knife of claim 3, wherein the mating features cause the first and second side portions of the blade retention member to interlock such that the blade and the first and second side portions of the blade retention member are prevented from moving laterally relative to each other.

7. The folding knife of claim 6, wherein the mating features form a dovetail connection.

8. The folding knife of claim 6, wherein the mating features form a tongue-and-groove connection.

9. The folding knife of claim 1, wherein the blade is a disposable blade.

10. A folding knife comprising:

a handle comprising a first side portion and a second side portion, wherein the first and second side portions of the handle are laterally spaced apart and separable from each other;

a pivot element disposed inside the handle;

a blade retention member comprising a blade-receiving recess and a pivot opening through which the pivot element extends; and a replaceable blade partially disposed in the blade-receiving recess, the blade comprising a pivot opening through which the pivot element extends and a cutting edge portion that extends outside of the blade-receiving recess, wherein the blade retention member comprises first and second side portions positioned on opposite sides of the blade, wherein the first and second side portions of the blade retention member comprise mating features that allow the blade to be coupled to and removed from the blade retention member without use of a tool, and wherein the mating features cause the first and second side portions of the blade retention member to interlock such that the blade and the first and second side portions of the blade retention member are prevented from moving vertically relative to each other, and wherein the blade retention member and the blade are pivotable relative to the handle between an open configuration in which the cutting edge portion of the blade is exposed from the handle for use and a closed configuration in which the cutting edge portion of the blade is concealed by the handle.

11. The folding knife of claim 10, wherein the mating features comprise the blade-receiving recess formed in the first side portion of the blade retention member and a projection extending from the second side portion of the blade retention member, and wherein the recess is configured for receiving the projection of the second side portion of the blade retention member.

12. The folding knife of claim 11, wherein the recess and the projection extend laterally.

13. The folding knife of claim 10, wherein the mating features cause the first and second side portions of the blade retention member to interlock such that the blade and the first and second side portions of the blade retention member are prevented from moving laterally relative to each other.

14. The folding knife of claim 13, wherein the mating features form a dovetail connection.

15. The folding knife of claim 13, wherein the mating features form a tongue-and-groove connection.

16. The folding knife of claim 13, wherein the mating features comprise pins and openings, wherein each opening of the mating features is configured for receiving at least a portion of a respective one of the pins.

17. The folding knife of claim 10, wherein the blade is a disposable blade.

* * * * *